US007510517B2

(12) United States Patent
Goodman

(10) Patent No.: US 7,510,517 B2
(45) Date of Patent: Mar. 31, 2009

(54) CASE ERECTOR APPARATUS

(75) Inventor: James A. Goodman, Glencoe, IL (US)

(73) Assignee: Prototype Equipment Corporation, Lake Forest, IL (US)

( * ) Notice: Subject to any disclaimer, the term of this patent is extended or adjusted under 35 U.S.C. 154(b) by 0 days.

(21) Appl. No.: 11/526,851

(22) Filed: Sep. 25, 2006

(65) Prior Publication Data

US 2007/0072757 A1 Mar. 29, 2007

Related U.S. Application Data

(60) Provisional application No. 60/720,242, filed on Sep. 23, 2005.

(51) Int. Cl.
*B31B 1/76* (2006.01)

(52) U.S. Cl. ..... 493/313; 493/317; 53/564; 53/566

(58) Field of Classification Search ..... 493/123–125, 493/309, 313, 317; 53/458, 564, 566, 573, 53/381.1, 382.1
See application file for complete search history.

(56) References Cited

U.S. PATENT DOCUMENTS

| | | | | |
|---|---|---|---|---|
| 4,578,054 | A * | 3/1986 | Herrin | 493/126 |
| 5,382,217 | A * | 1/1995 | Namowitz | 493/310 |
| 5,531,661 | A * | 7/1996 | Moncrief | 493/313 |
| 6,240,707 | B1 * | 6/2001 | Ford et al. | 53/381.1 |
| 6,764,436 | B1 * | 7/2004 | Mazurek | 493/120 |
| 6,886,311 | B2 * | 5/2005 | Toth et al. | 53/456 |
| 6,915,622 | B2 * | 7/2005 | Spatafora | 53/458 |
| 6,951,530 | B2 * | 10/2005 | Toth et al. | 493/55 |
| 7,243,481 | B2 * | 7/2007 | Draghetti | 53/458 |

* cited by examiner

*Primary Examiner*—Hemant M Desai
(74) *Attorney, Agent, or Firm*—Lee & Hayes, PLLC

(57) ABSTRACT

A case erector is provided which is easily adaptable to different sizes and shaped of R.S.C. cases and the like. The case erector includes a case erector system including a pair of vacuum heads, the range and motion of each being actuated by linear servos. A first vacuum head travels in a longitudinal direction relative to the flow of cases through the case erector. A second vacuum head travels in a direction transverse to the flow of cases through the case erector. The action of the pair of vacuum heads and the motion thereof erects or expands the cases.

13 Claims, 10 Drawing Sheets

CASE ERECTOR APPARATUS

This application claims the benefit of U.S. Provisional Application No. 60/720,242 filed Sep. 23, 2005.

FIELD OF THE INVENTION

This invention relates generally to an apparatus for handling boxes or cartons, and more particularly to an apparatus for automatically erecting, closing and sealing of the flaps of a container. The invention is particularly applicable to the erecting and closing of cardboard cases or boxes and is quickly and accurately adaptable to accommodating different sized boxes.

BACKGROUND OF THE INVENTION

Packaging systems are an important aspect of manufacturing. A significant expense in manufacturing is the erecting of a case from a blank, packing the case with product, and sealing the case after filling. Cases include, for example, containers, boxes, cartons and similar packages for containing product, which are made of paper, cardboard and similar materials. Until recent times, human hands have performed the tasks of assembling, packing and sealing cases.

While mechanisms for erecting, filling and sealing cases are well known in the art, the ability to change a packaging line to erect and seal a different type or sized case often requires the shutting down of the packaging line to adapt the setup and sealing machinery to the new case. This adaptation not only causes a pause in production, but may require both the time and expense of mechanics changing over the machinery and attaching different packaging machinery parts. In such a case, space is needed to store the different packaging machine parts and a system to keep track of the parts needed for various sized cases, and adding to the overall cost of the packaging system.

Increasingly, automated systems are being developed to reduce the human and material resources needed to erect or assemble, pack and seal different cases as well as reduce the time needed for adaptation to different packaging operations. It is well known that cases are available in a wide range of configurations, each configuration having specific erecting, closing and sealing requirements.

In one example, the Regular Slotted Container (RSC) is a case which includes four flaps making up the bottom thereof and four flaps making up the top. Each of the top and bottom four flaps are comprised of a pair of opposed minor flaps alternating with a pair of opposed major flaps. The remainder of an RSC box includes four panels, which in the example of a rectangular case, includes a pair of opposed major panels and a pair of opposed minor panels wherein the major panels have a greater area than the minor panels. Numerous methods have been proposed which are used to seal RSC boxes.

Typically, the erecting and sealing of a regular slotted container proceeds along the following lines. From an initial flattened condition, the minor and major panels are expanded into a box-like or rectangular configuration and glue is applied to specified surfaces of the minor bottom flaps. The bottom flaps are then folded inwardly, with the major or outer flaps outwardly positioned over the minor or inner flaps and held in contact therewith until the glue is sufficiently set. This process can be carried out either manually or by machine and is not overly difficult since the case is empty at this stage, access to the various elements of the case and pressure can be applied from above and below so as to sandwich the bottom flaps in the closed position until it is assured that the glue is sufficiently set. Machines specially adapted for erecting a folded blank into a box configuration, applying glue to the bottom flaps and folding the same, are known in the art. The case can also be opened and flaps folded as stated above and then passed over a tape applicator which applies a strip of tape vertically on one minor panel (approximately 3") then across the bottom then up the opposite minor panel (3").

As discussed above, the filling or packing of cases can be performed manually or, with increasing frequency by mechanical means. Robotic packing machines are being used to fill cases with product as robotic technology becomes more affordable and widespread. Machines specially adapted for closing case tops for RSC cases are exemplified by machinery described in for example, U.S. Pat. No. 4,524,560.

However, as noted above, changeover from one configuration or size of case to another can be time consuming and thereby can add unwanted cost to the process. Accordingly, there is a demand for a mechanism that efficiently erects cases and is easily and quickly adaptable to different sized and shaped containers. The present invention satisfies the demand.

SUMMARY OF THE INVENTION

The present invention has a principal objective of providing a device and method of erecting a RSC or equivalent case in an efficient manner and being easily adaptable to accommodate different sizes and shapes of cases. Broadly stated, this is accomplished by a case erector apparatus including a pair of vacuum heads. The range and motion of each of the vacuum heads may be performed by separate linear servos. A first vacuum head travels in a longitudinal direction relative to the flow of cases through the case erector. A second vacuum head travels in a direction transverse to the flow of cases through the case erector. In a most general form, each case is erected by simultaneously moving a first major panel of the case in an upstream direction (opposite flow direction) while moving the opposite major panel of the case in an outward (transverse) direction. Performed by the first and second vacuum heads being attached to respective first and second major case panels, this results in the case being expanded from a flat, knocked-down condition to a fully erected, expanded, or rectangular or square condition. After being erected, the case bottom may be sealed, product may be introduced into the case and the top may be sealed in a conventional fashion.

It will be understood that the present invention may be incorporated as a subsystem thereof into a case forming, packing and closing system with box-forming, packing and box sealing capabilities or alternately, may be provided as a stand alone unit. These and other advantages, as well as the invention itself, will become further apparent in the details of construction and operation as more fully described below.

DETAILED DESCRIPTION OF PRESENTLY PREFERRED EMBODIMENTS

Figure 1:
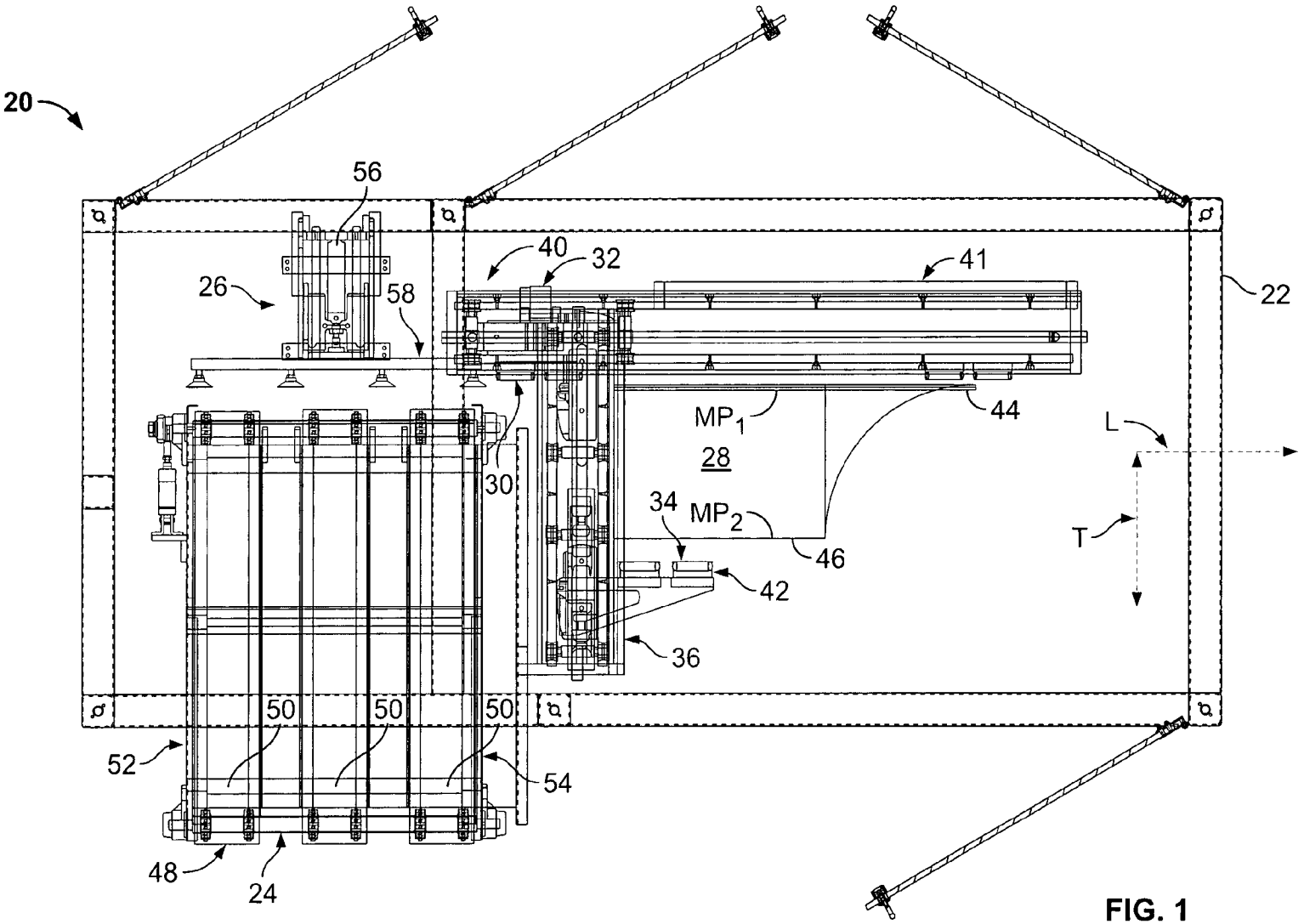
FIG. 1 is a top view of a case erector assembly showing some of the elements of an embodiment of the present invention including a case erector station and a case transfer/opening system.

FIG. 1 shows a top view of one embodiment of the present invention. It will be understood that reference to elements of the invention, and description of relative positions thereof, will be given according to their orientation depicted in the drawings and are not intended to be limiting. Identical parts of the apparatus are labeled with the same reference characters in the figures. The invention is useful in erecting RSC-type cases, boxes, cartons, containers or the like. These types of cases are well known and are described briefly above.

Turning to FIG. 1, a case erector system according to an embodiment of the present invention is generally shown at 20. The case erector system 20 includes a suitable frame assembly 22 for receiving the various elements, controls and conveyances of the system. Generally, the major elements of the case erector system 20 include a case magazine 24 for storing and delivering a number of knocked-down RSC cases (not shown) or the like. A case transfer system 26 picks cases from the case magazine 24 and stages each individual case. The case transfer system 26 transfers cases to a case erector station 28. The transfer of the case to the case erector station 28 is accomplished by a first vacuum head 30 contacting and attaching to a first major panel MP1 of the case, whereby the first vacuum head and thus the case is moved by a first servo mechanism 32 mounted to move the first vacuum head in a longitudinal direction L. A second vacuum head 34, controlled by a second servo mechanism 36 and mounted to move in a transverse direction T, is moved inwardly to contact a second major panel MP2 and attach thereto.

The case is expanded/erected when the first vacuum head 30 moves backwards to a starting position 40 adjacent the case magazine 22 at approximately the same time the second vacuum head 34 is moved to an initial position 42. The case is shown in a knocked-down or flat initial condition at 44 and expanded at 46. After being erected, the case 46 may have the bottom sealed (see FIG. 2), packed and closed for shipping, etc.

The case erector system 20 includes a case magazine 24 mounted to the frame 22. The case magazine 24 may be a powered magazine, which may be provided with the capacity of holding a plurality of (e.g., 100 to 200 cases) knocked-down RSC cases. Advantageously, the case magazine 24 may be refilled during operation of the case erector system 20. Generally, the case magazine 24 includes a conveyor 48, with one or a plurality of belts 50. The belts 50 operate to advance the flat cases 44 transversely toward the case transfer mechanism 26. The belts 50 may be slightly inclined downwardly toward the case transfer mechanism 26. The case magazine 24 may have first and second walls 52, 54 to support the cases 44 in an upright, on edge position with a first panel MP1 presented toward the case transfer system 26.

The case transfer system 26 includes a servo 56 for moving a case transfer vacuum head 58 along the transverse direction T to pick cases 44 from the case magazine 24. Flat cases 44 are picked from the case magazine 24 by the case transfer vacuum head 58 contacting or attaching (by way of the vacuum applied thereby) to the outside surface of the first major panel MP1. The case transfer vacuum head 58 moves the case 44 to a position below and alongside the magazine 24. The case 44 advances a short distance by way of a conventional conveyor (not shown) to a stop (see FIG. 3). The motion and control of the case transfer vacuum head 58 is performed by the servo 56, the function of which may be adapted to different sized and shapes of cases by adjusting a conventional servo control mechanism (not shown). The servos for the case transfer system 26 and the first and second servo mechanism 32, 36 may be provided by Copley Controls Corp.

When the case erector station 28 has been cleared of a previously erected case, the first vacuum head 30 attaches (by applying negative pressure) at the starting position 40 to the major panel MP1 and the first linear servo mechanism 32 advances the case 44 to the case erector station 28. At this point, the first vacuum head 30 travels to and reaches the position indicated at 41. The case, when in the position shown in the figure, is initially in the flat condition shown at 44. The first vacuum head 30 maintains a vacuum grip on panel MP1 while second servo mechanism 36 moves the second vacuum head 34 inwardly along direction T toward and into contact with panel MP2. Simultaneously, or nearly so, both first and second servo mechanisms 32, 36 withdraw respective vacuum heads 30, 34 to their respective starting positions drawing the panels MP1 and MP2 outwardly and expanding the box into the condition shown at 46, i.e., fully open and square.

It will be understood that any system of controls and ancillary components to accomplish the above are contemplated, including complete electrical and pneumatic controls including a main disconnect switch, motor starters, solenoid valves, air lines, filter-regulator-oilers, motors, belts, framework and so on. An Allen-Bradley Micrologix PLE, for example, may be utilized to control the operation of the case erector 20. It will be understood that the various control functions are performed by a control system, which may be any suitable control system, the design, application and control of which is considered to be within the capabilities of one skilled in the art.

It will be also be understood that other devices may be integrated into the case erector 20 or associated therewith such as, for example, closing, taping, gluing, labeling, wrapping, coding, and weighing devices or other substations.

The aspects of the case erector system 20 shown include a case magazine 24 and a case transfer system 26, which picks cases from the case magazine 24 and stages each individual case. The case transfer system 26 transfers cases to a case erector station 28 (see FIG. 1) to be erected. A case is shown in a knocked down condition at 44 and erected at 46.

After the case is open, a side conveyor assembly 58 closes in toward longitudinal centerline C to contact the case 46. The side conveyor assembly 58 includes a first side belt 60 on one side of centerline C adjacent case erector station 28 and a second side belt 62 on an opposite side of centerline C from the first side belt. Each of the first and second side belt 60, 62 includes a pivoting in-feed arm 64, which pivots inwardly to contact the major panels MP1 and MP2. At this point, the minor flaps (not shown) of the case are folded and the major flaps (not shown) are folded to assure a tight and square closure.

The side conveyor system 58 moves the case 46 with the bottom flaps in a closed condition over a bottom-taping machine (not shown) at a position downstream 66 from the pivoting in-feed arms 64. An example of a preferred machine for bottom taping is manufactured by DEKKA. At the position where tape is applied to the bottom of the case 46, the first and second side belts 60, 62 are fixed and do not pivot to provide case shape (squared) and a well braced bottom surface for secure tape application thereto.

Figure 3:
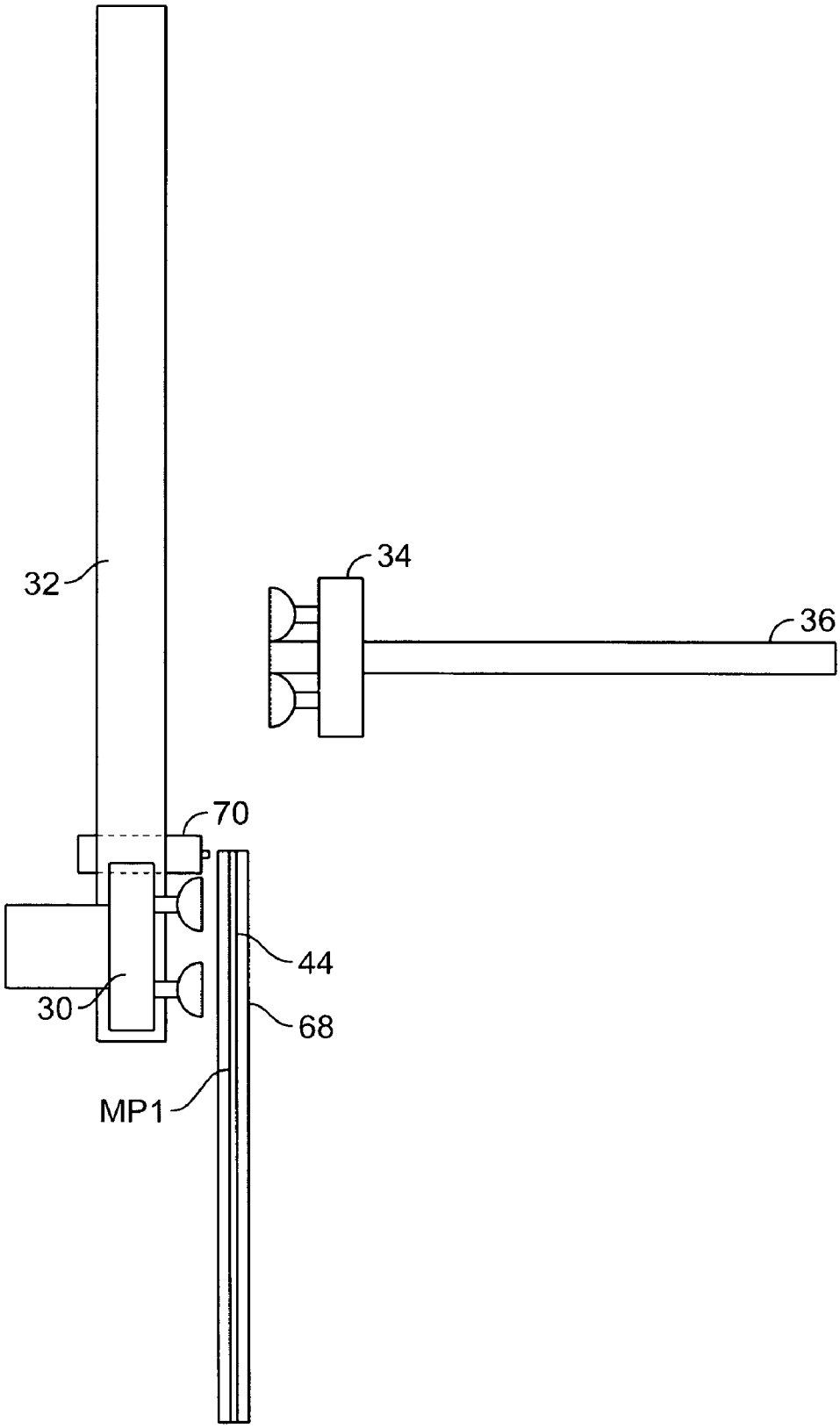
FIGS. 3-6 illustrate operation of the case transfer and opening system and the side belt conveyor.

FIGS. 3-6 diagrammatically illustrate some further aspects of the case erecting device 20 and function of the present invention. Reference is made to the elements shown herein, which are described in more detail above and below. FIG. 3 shows a case blank 44 in an initial flattened condition and resting on a conveyor (not shown) after being picked from the case magazine 24 (see FIG. 1). The case 44 is held after being picked from magazine 24, by a pair of guides 68 and conveyed to a stop pin 70. The stop pin 70 is located at position 40 (see FIG. 1) which may be considered an initial starting position for the case erecting process. The vacuum head 30 or (longitudinal) linear servo 32 moves inwardly to contact the panel MP1 and attaches to the adjacent major panel MP1 of case 44.

Figure 4:
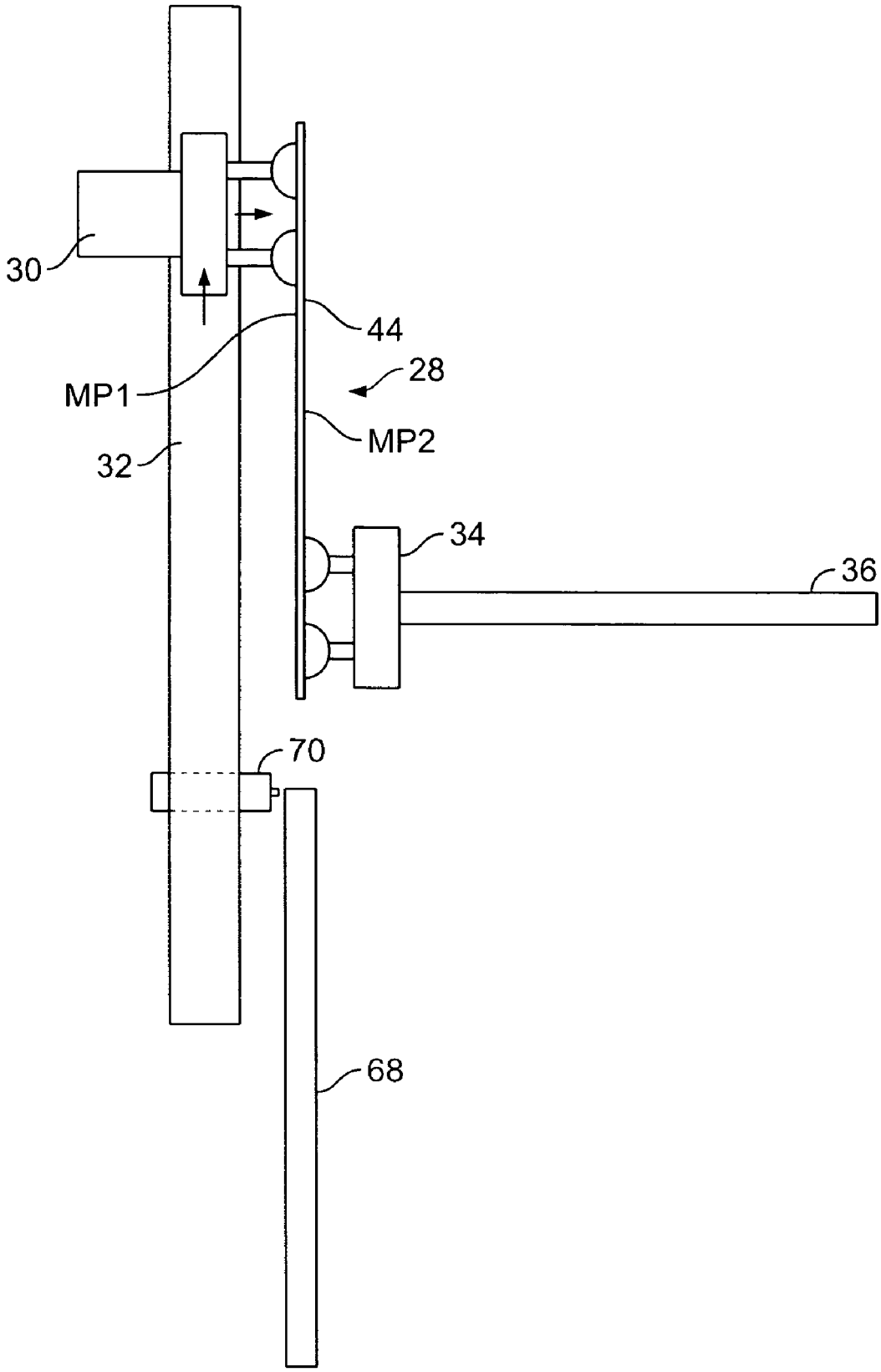

Turning to FIG. 4, when the stop pin 70 is retracted, the case 44 is advanced a programmed distance fully into the case erecting station 28 by longitudinal motion of the linear servo 32 while the major panel MP1 is gripped by the vacuum head 30. The second linear (transverse) servo 36 advanced the second vacuum head 34 into contact with the second major panel MP2 and is gripped through application of negative pressure thereby.

Figure 5:
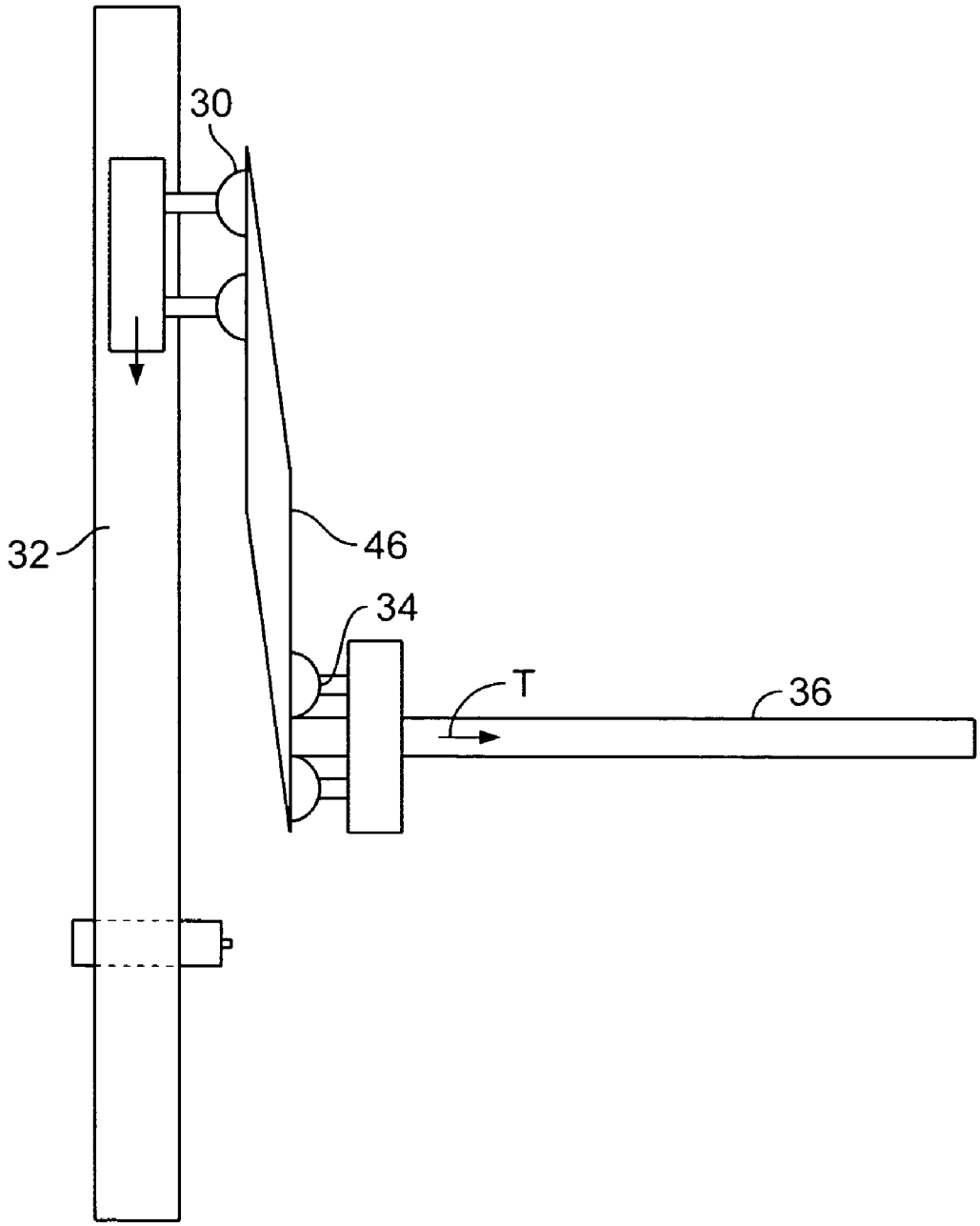

Turning to FIG. 5, as the first linear servo 32 moves the first vacuum head 30 longitudinally into an initial starting position, the second linear servo 36 moves the second vacuum head 34 transversely into its initial starting position the panels MP1 and MP2 are drawn apart and the case 44 is expanded from a flat condition into a parallelogram and ultimately into a rectangular shape, i.e., as case 46.

Figure 2:
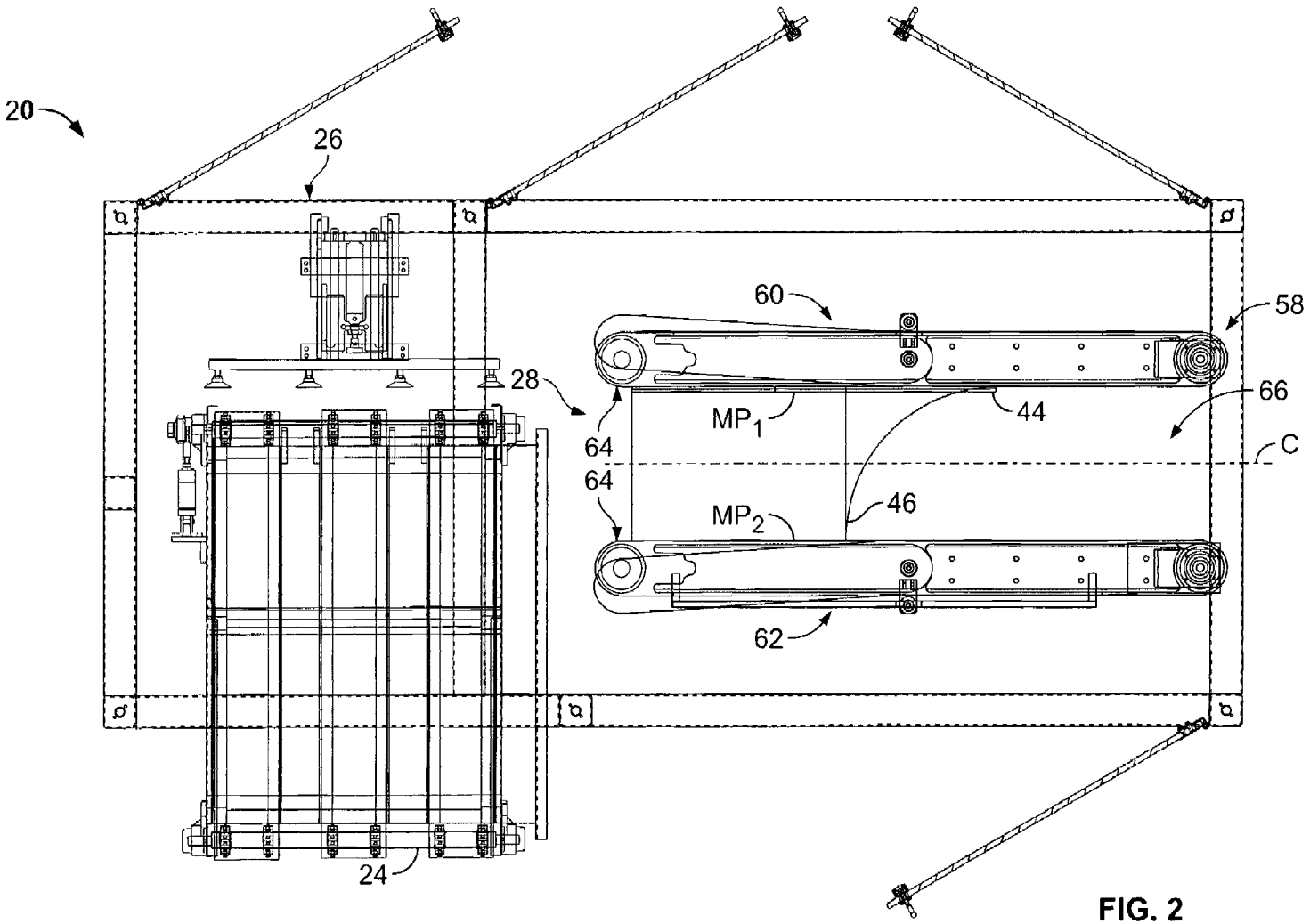
FIG. 2 is a top view showing other elements of the assembly of FIG. 1 including a case erector station and a conveyor system.
Figure 6:
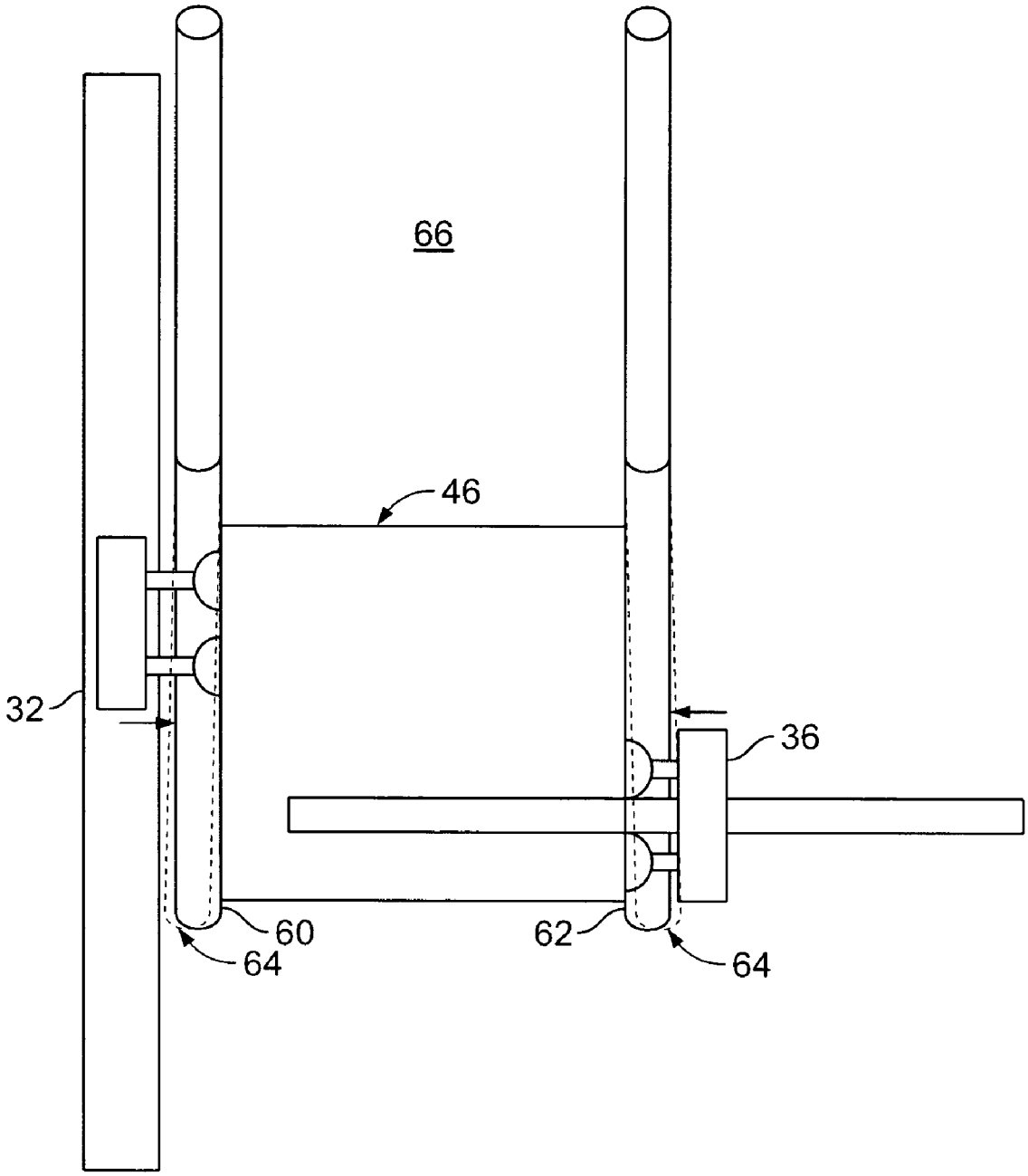
Figure 7A:
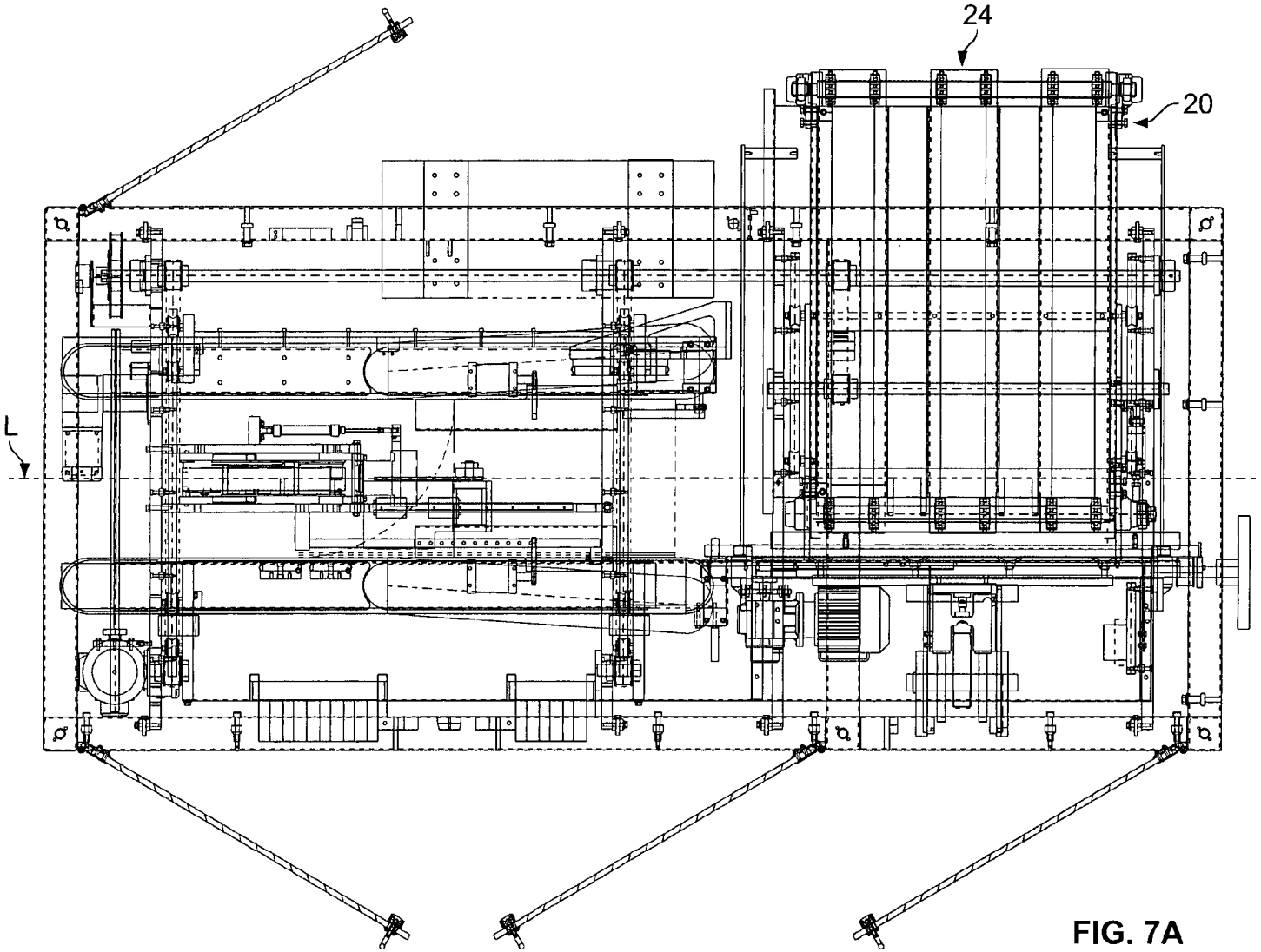
FIGS. 7A-D respectively illustrates top, front, side and rear views of an embodiment of the present invention.
Figure 7B:
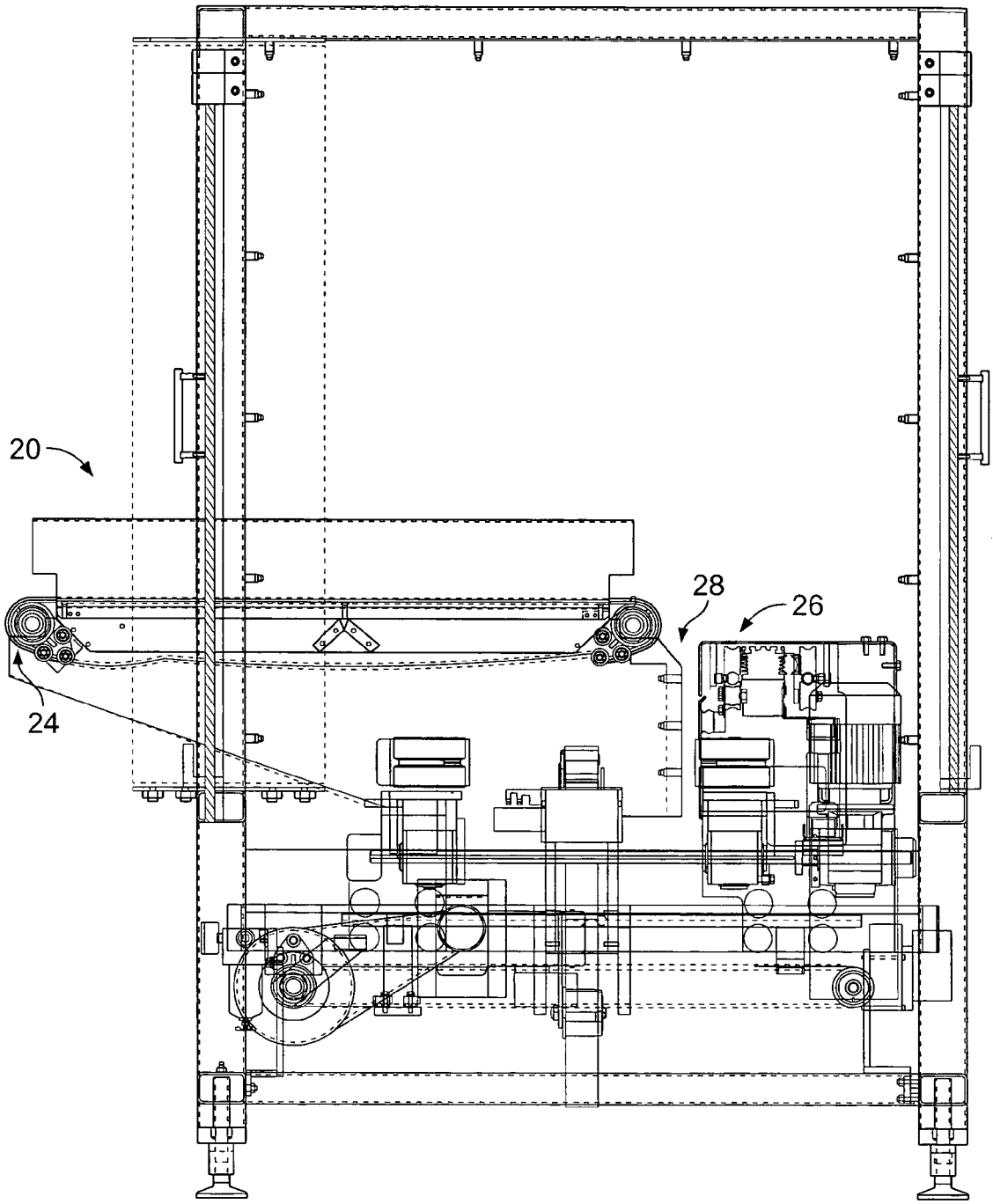
Figure 7C:
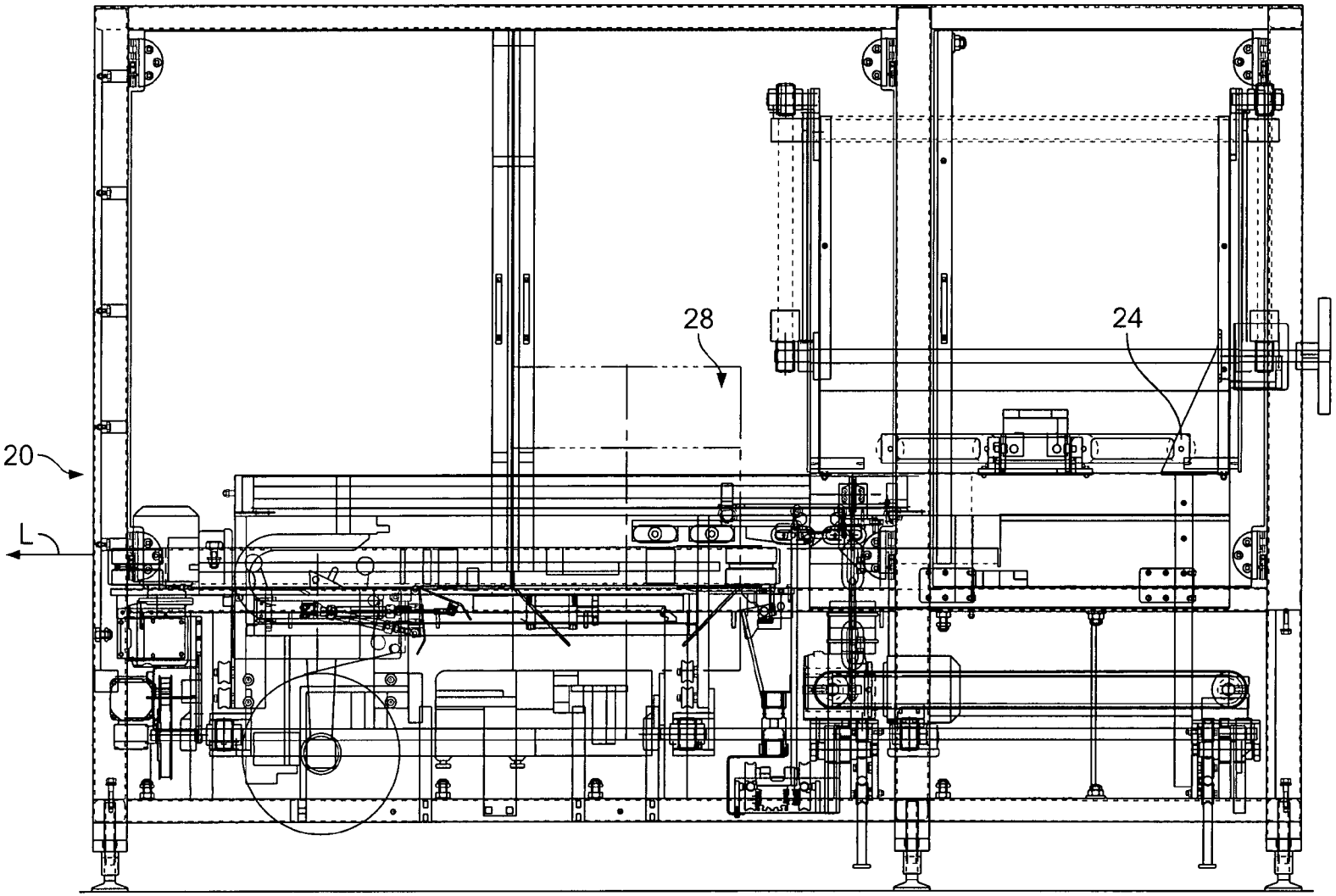
Figure 7D:
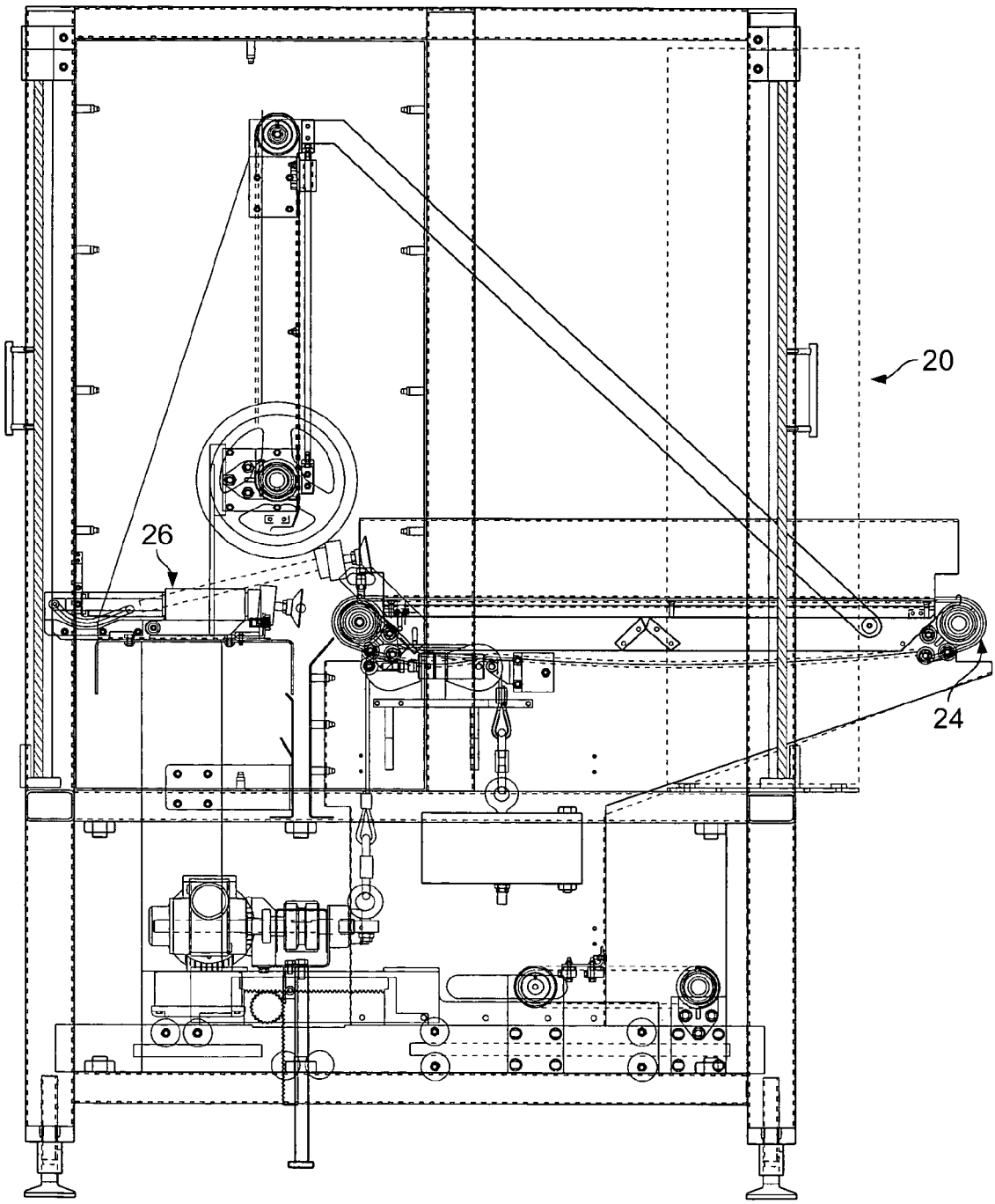

Referring to FIG. 6 in light of FIG. 2, the linear servos 32, 36 have fully erected the case 46 and complete their coordinated move to return to an initial starting position. Pivoting arms 64 of first and second side belts 60, 62 clamp the opened case 46 as the case bottom minor and then major flaps are closed (not shown) at or near the downstream terminus 66 of the device 20.

FIGS. 7A-D illustrates various views of the system described below and in particular show the arrangement of the case erector system generally shown at 20. The case erector system 20 includes a suitable frame assembly 22 for receiving the various elements, controls and conveyances of the system. Generally, the major elements of the case erector system 20 include the case magazine 24 for storing and delivering a number of knocked-down RSC cases (not shown) or the like. A case transfer system 26 picks cases from the case magazine 24 and stages each individual case. The case transfer system 26 transfers cases to a case erector station 28. The transfer of the case to the case erector station 28 is accomplished by a first vacuum head contacting and attaching to a first major panel MP1 of the case, whereby the first vacuum head and thus the case is moved by a first servo mechanism mounted to move the first vacuum head in a longitudinal direction L (see previous figures). A second vacuum head controlled by a second servo mechanism and mounted to move in a transverse direction T, is moved inwardly to contact a second major panel MP2 and attach thereto (see previous figures).

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims such as the use of rotary servo motors driving belts to create the motions of the two vacuum systems.

What is claimed is:

1. An apparatus for erecting cases, comprising:

a first vacuum head operatively controlled by a first mechanism;

a second vacuum head operatively controlled by a second mechanism;

said first mechanism providing motion to said first vacuum head in a first longitudinal direction through said apparatus and said second mechanism providing motion to said second vacuum head in a second transverse direction, wherein there is an approximately 90 degree differential between said second direction and said first direction.

2. The apparatus of claim 1, wherein said first and second mechanisms include servo mechanisms.

3. The apparatus of claim 1, wherein said first vacuum head is adapted to attach to a first major case panel of the case and said second vacuum head is adapted to attach to a second major case panel opposite the first major case panel.

4. The apparatus of claim 3, wherein said first vacuum head is adapted to move the first major case panel in an reverse flow direction along said first direction while said second vacuum head is adapted to move the second major panel of the case in a direction outward from said first direction along said second direction to erect the case.

5. An apparatus for erecting cases, comprising:

a frame having a longitudinal direction;

a case magazine mounted to said frame, said case magazine including a case magazine conveyor;

a case transfer system positioned adjacent the case magazine for receiving cases from said case magazine conveyor, said case transfer system including a servo controlled case transfer vacuum head;

a first vacuum head operatively controlled by a first mechanism to move along a first longitudinal direction, and positioned at a starting position to receive cases from said case transfer system; and a second vacuum head operatively controlled by a second mechanism to move along a second direction wherein there is an approximately 90 degree differential between said second direction and said first direction.

6. The apparatus of claim 5, wherein said first and second mechanisms include servo mechanisms.

7. The apparatus of claim 5, wherein said first vacuum head is adapted to attach to a first major case panel of the case and said second vacuum head is adapted to attach to a second major case panel opposite the first major case panel.

8. The apparatus of claim 7, wherein said first vacuum head is adapted to move the first major case panel in an reverse flow direction along said first direction while said second vacuum head is adapted to move the second major panel of the case in a direction outward from said first direction along said second direction to erect the case.

9. The apparatus of claim 5, including a retractable pin positioned at said starting position.

10. The apparatus of claim 5, including a side conveyor assembly positioned downstream from said first and second vacuum heads.

11. The apparatus of claim 10, wherein said side conveyor assembly includes a spaced pair of pivoting arms positioned downstream from said first and second vacuum heads to receive erected cases.

12. The apparatus of claim 11, further including a pair of side belts; each of said pair of side belts being positioned on one of said pair of pivoting arms for conveying erected cases.

13. The apparatus of claim 12, wherein said pair of side belts function to convey erected cases through one or more case loading and case closing device.

* * * * *